United States Patent [19]

Donegan

[11] 4,051,906

[45] Oct. 4, 1977

[54] EXTENSION RODS USED IN PERCUSSIVE DRILLING

[75] Inventor: Edward Alfred Donegan, St. Catharines, Canada

[73] Assignee: TRW Canada Limited, Canada

[21] Appl. No.: 663,266

[22] Filed: Mar. 3, 1976

[51] Int. Cl.[2] ..... B25D 9/00

[52] U.S. Cl. ..... 173/131; 175/320

[58] Field of Search ..... 173/128, 129, 130, 131, 173/132, 133; 175/320, 56; 64/1 S, 23

[56] References Cited

U.S. PATENT DOCUMENTS

| | | | |
|---|---|---|---|
| 3,138,216 | 6/1964 | Heiskanen et al. | 175/320 |
| 3,152,458 | 10/1964 | Simonin | 175/320 |
| 3,525,237 | 8/1970 | Lari | 175/320 |
| 3,570,609 | 3/1971 | Wise | 173/131 |
| 3,572,771 | 3/1971 | Redwine | 175/320 |
| 3,876,471 | 4/1975 | Jones | 175/320 |

*Primary Examiner*—Robert A. Hafer

[57] ABSTRACT

A percussive drill extension rod having first and second externally threaded ends, a rod zone therebetween, and a substantially round, internal bore in the threaded ends and rod zone along the longitudinal axis of the extension rod, with particular relative dimensions designed to improve performance and reduce costs. The first threaded end of the extension rod has an outside diameter (TD) in the range of about 1.25 to about 2.5 inches, and the rod zone has an outside diameter (RD) within a range from about equal to the outside diameter (TD) of the first threaded end to about 1.1 times the outside diameter (TD) of the first threaded end. The first threaded end has a cross-sectional area (TDX) derived from the specific outside diameter of the threaded end (TD) selected from the given range of about 1.25 to about 2.5 inches. The rod zone has an annular cross-sectional area (RX) equal from about 0.64 to about 0.76 times the circular cross-sectional area (TDX) based upon the outside diameter (TD) of the first threaded end, the internal bore in the rod zone having a diameter (RB) equal to 2 ($\sqrt{(\text{circular cross section (RDX) based on the outside diameter (RD) of the rod zone minus the annular cross section (RX) of the rod zone) divided by } \pi}$). The first and second threaded ends may have equal outside diameters or unequal in which case such an extension rod is commonly called a jumbo rod.

7 Claims, 4 Drawing Figures

EXTENSION RODS USED IN PERCUSSIVE DRILLING

BACKGROUND OF THE INVENTION

This invention relates to extension rods used in percussive drilling in the mining and construction industries. An extension rod transmits impact energy from a percussive drill to a drill bit, the percussive drill remaining above the surface of the ground and the drill bit penetrating below surface to a depth roughly equivalent to the length of the extension rod. Greater depths may be drilled by connecting two or more extension rods together with coupling sleeves to form an extension rod string.

There are a variety of names given extension rods as used in percussive drilling, such as drill rods, extension drill steel, sectional drill steel and extension rod. For the sake of uniformity throughout the specification, the term "extension rod" will be employed.

It has been noted in percussive drilling that bending or flexural straining has an important effect on extension rod life and that impact energy which is diverted into flexural waves has the effect of reducing energy available for breaking rock. For example, it has been noted that such flexural strain can be as high as 70% of the normal longitudinal strain, and that it is largely responsible for extension rod breakage. William A. Hustrulid, *A Study of Energy Transferred to Rock and Prediction of Drilling Rates in Percussive Drilling,* University of Minnesota Master of Science Thesis (1965). The flexural waves also increase surface stress up to about 50% and produce considerable tensile stresses at certain points, which contribute to a reduction in fatigue life of the extension rod. H. C. Fischer, "Stress Pulses in Percussive Drilling," *International Symposium on Mining Research,* Vol. II (1961). It is, therefore, not surprising that these flexural waves further reduce extension rod life in addition to the normal tensile and compressive stresses in percussive drilling. Curt Dahlin, "Factors Influencing the Life of Drill Steel Equipment," *International Symposium on Mining Research,* Vol. 1 (1961).

The effect of flexural strains on the life of extension rods can be compensated for by improving the resistance to flexing or bending. However, such as improvement should not be obtained by increasing the cross-sectional area of the rod zone because this will increase both the weight and cost of the extension rod.

In rotary drilling operations the fatigue life of drill collars has been enhanced by providing greater flexibility in the zone adjacent to the threaded ends of the collar. See for example U.S. Pat. No. 3,730,286. However, rotary drill collars are not subjected to high velocity strain pulses superimposed on the rotary forces, as in percussive drilling, and flexural pulses or waves are virtually not present. Extension rods of the present invention are provided with greater rigidity through an increase in the moment of inertia, this being accomplished without increases to the cross-sectional area, as will be explained in more detail hereinafter.

As is well known in the art, rotary drilling consists of a tri-cone bit connected to a rotary drilling machine by a very long drill string. The drill string and the drilling machine comprise a large static weight which rests upon the tri-cone bit, the rotation of which under the great static weight creates a high loading which grinds or bursts the rock. In contrast, percussive drilling involves transmission of impact energy in the form of high velocity strain pulses, superimposed on the rotary forces, as discussed previously, and from this viewpoint the weight of the extension rod string is virtually irrelevant. In effect, what is being described is the difference between a static and a dynamic system. Percussive drilling with an out of hole (above ground surface) drill is efficient down to depths of about 60 ft.; beyond this point penetration is very slow due to energy losses in the extension rod string. This technique is used in quarrying, road construction, underground drilling, and pipeline construction and is fast, efficient, and highly mobile. Because of these differences in operating procedure between percussive drilling and rotary drilling, extension rods used in percussive drilling are too small to be used in rotary drilling operations. A further distinction between these two types of drilling operations lies in the removal of cuttings from the drilling hole; in percussive drilling cuttings are generally removed by air, whereas in rotary drilling a drilling mud is used to create a liquid flow which will lift the cuttings from great depths. Also, the types of threads used in percussive drilling and rotary drilling are completely different. In rotary drilling, a machine is needed to unthread the drill collars, whereas in percussive drilling no special machine is needed. In fact, the extension rods may be unthreaded by simply terminating the rotary forces and maintaining the impact forces to loosen the threaded connections.

SUMMARY OF THE PRESENT INVENTION

It is an object of the present invention to increase the stiffness and strength to weight ratio of percussive extension rods without increasing either the cost or the weight of such rods. This is achieved by a percussive drill extension rod having first and second externally threaded ends, a rod zone therebetween, and a substantially round, internal bore in the threaded ends and rod zone along the longitudinal axis of the extension rod, with particular relative dimensions designed to improve performance and reduce costs. The first threaded end of the extension rod has an outside diameter (TD) in the range of about 1.25 to about 2.5 inches, and the rod zone has an outside diameter (RD) within a range from about equal to the outside diameter (TD) of the first threaded end to about 1.1 times the outside diameter (TD) of the first threaded end. The first threaded end has a cross-sectional area (TDX) derived from the specific outside diameter of the threaded end (TD) selected from the given range of about 1.25 to about 2.5 inches. The rod zone has an annular cross-sectional area (RX) equal from about 0.64 to about 0.76 times the circular cross-sectional (TDX) area based upon the outside diameter (TD) of the first threaded end, the internal bore in the rod zone having a diameter (RB) equal to 2 (circular $\sqrt{(}$cross section (RDX) based on the outside diameter (RD) of the rod zone minus the annular cross section (RX) of the rod zone) divided by $\pi$). The first and second threaded ends may have equal outside diameters or unequal in which case such an extension rod is commonly called a jumbo rod.

DESCRIPTION OF THE DRAWINGS

Details and advantages of the present invention appear from the following description and the accompanying drawings in which.

DETAILED DESCRIPTION OF THE INVENTION

Figure 1:
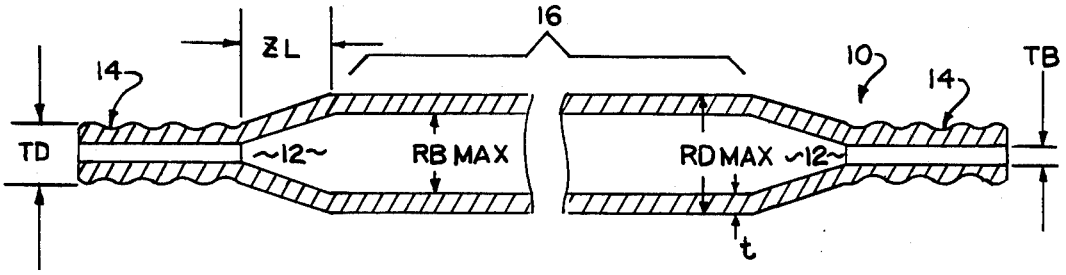
FIG. 1 shows an extension rod in cross section having the maximum relative dimensions in accordance with the present invention.

With reference to FIG. 1, extension rod 10 is generally cylindrical with a bore 12 throughout the length of the extension rod 10 and concentric along the longitudinal axis thereof. Each end thereof comprises a threaded portion 14 for insertion into a coupling sleeve (not shown). Adjacent the threaded end 14 is an external transition zone ZL comprising an increasing frustoconical surface area; the external transition zone ZL accommodates the difference, if any, between the diameter of the threaded end 14 (TD) and the outer diameter of the rod zone 16 (RD) which is immediately adjacent the external transition zone ZL. Internally, bore 12 has a dimension of TB in the threaded end and then increases into the internal transition zone Z1 and rod zone 16. The internal transition zone Z1 (shown in FIG. 2 for clarity) accommodates the bore increase from the smaller diameter in the threaded end (TB) and the larger bore in the rod zone (RB). The internal transition zone Z1 is similar in shape to the outer transition zone ZL except that the internal transition zone does not necessarily correspond in length to the external transition zone ZL. The external transition zone ZL and the internal transition zone Z1 generally approximate a frustoconical surface, and although the drawings depict them with angled intersections with the surface areas of the rod 10, in actual practice such intersections may be rounded.

Figure 2:
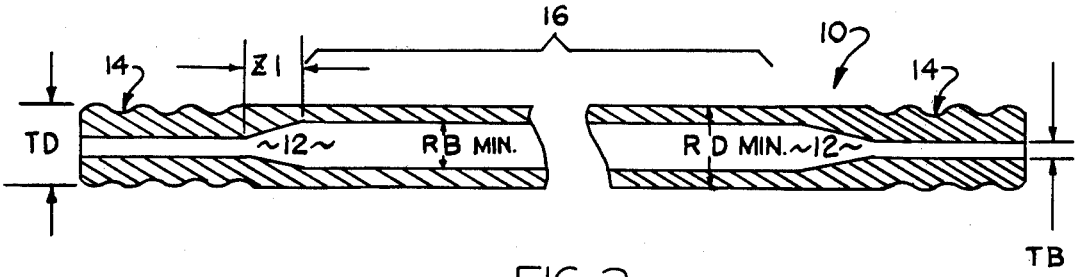
FIG. 2 shows an extension rod in cross section having the minimum relative dimensions in accordance with the present invention.

FIG. 2 is similar to FIG. 1 and depicts the minimum rod zone outer diameter RD contemplated within the present invention, i.e., RD equals TD.

Figure 3:
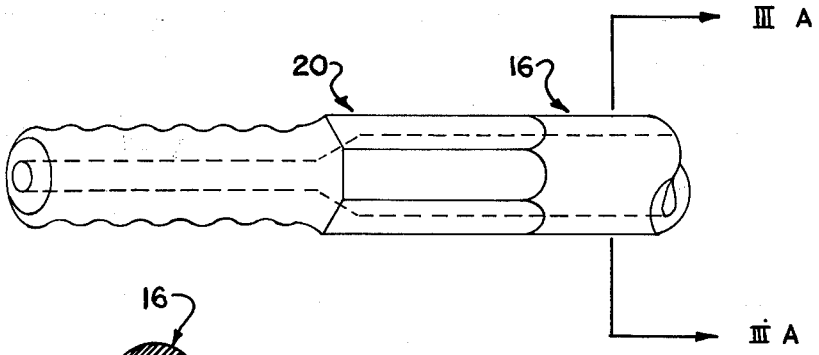
FIG. 3 shows a side elevation of one end of a drill rod having a round outside and inside shape with wrench flats in a portion thereof with the cross section along line IIIA—IIIA shown in FIG. 3A.
Figure 3A:
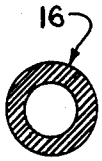

FIG. 3 shows a variation in the outer surface of the rod zone 16. Wrench flat 20 may be provided to allow a means by which the extension rods may be uncoupled using a Crescent or fixed end wrench as opposed to a pipe wrench. Preferably, the wrench flat 20 is hexagonal in shape, but it can be any suitably shaped surface for making engagement with a wrench. For example the wrench flat may be a single planar surface formed in one side of the drill rod, or two, three, four, etc., surfaces. One simple method for forming the wrench flat is by forging during the upset forging of the extension rod ends, which will be described with more particularity hereinafter. FIG. 3A shows the cross section along lines IIIA—IIIA in FIG. 3.

Throughout the specification, drawings, and claims the following symbols are used:

TABLE I

| SYMBOLS USED | |
|---|---|
| TD | Outside Diameter of Threaded End |
| TB | Inside Diameter of Threaded End |
| TDX | Cross Section in² Based on Outside Diameter of Threaded End |
| RD | Outside Diameter of Rod |
| RDX | Cross Section in² Based on Outside Diameter of Rod |
| RB | Inside Diameter of Rod |
| t | Wall Thickness of Rod |
| RX | Cross Section in² of Rod annulus |
| I | Moment of Inertia of Rod Cross Section |
| IF | Moment of Inertia Comparison Ratio |

TABLE I-continued

| SYMBOLS USED | |
|---|---|
| RF | Cross Section Comparison Ratio |
| SF | Strength to Weight Improvement Ratio |
| ZL | External Transition Zone Length |
| ZI | Internal Transition Zone Length |
| W | Weight in lbs/ft of Rod Portion |
| r | Radius of Gyration of Rod Portion |

Also throughout the specification and claims, the following formulae for rounding off numerical values to the relevant significant digit has been employed:

1. Numbers with 4 or less were rounded down;
2. Numbers with 5 or more were rounded up; for example:

1. 1.4944 → 1.494
2. 1.4945 → 1.495.

The novel structure of the extension rods of the present invention may be described by the following formulae:

TABLE II

| FORMULAE FOR BROAD RANGE PARAMETERS | |
|---|---|
| TD | 1.25" to 2.5" outside diameter |
| TB max | .38 TD |
| TDX | $\pi \frac{(TD)^2}{4} = .7854(TD)^2$ |
| RD min | TD |
| RD max | 1.1 TD |
| RDX | $\pi \frac{(RD)^2}{4}$ |
| RX min | .64 TDX |
| RX max | .76 TDX |
| RB | $2\left(\frac{\sqrt{RDX - RX}}{\pi}\right) = \sqrt{\frac{RDX - RX}{.7854}}$ |
| t | $\frac{RD - RB}{2}$ |
| I | $= \frac{\pi}{64}(RD^4 - RB^4) = .049(RD^4 - RB^4)$ |
| RF | $\frac{\text{RX of present invention}}{\text{RX of ISO* Standard Cross Section Hexagon}}$ |
| IF | $\frac{\text{I of present invention}}{\text{I of ISO Standard Cross Section Hexagon}}$ |
| W | 3.384 RX |
| r | $\sqrt{\frac{I}{RX}}$ |
| SF | $\frac{\text{r of present invention}}{\text{r of ISO Standard Hexagon}}$ |
| ZL | ≧ RD |
| ZI | ≧ RB |

*ISO stands for the International Organization for Standardization which publishes and sets standards for various systems, including percussive extension rods.

For purposes of comparison, the following table shows the prior art ISO Standard hollow hexagonal rod dimensions (ISO 1721 and 1722 (1974)):

TABLE III

ISO STANDARD SIZES
HOLLOW HEXAGON DRILL STEEL
ISO 1721 & 1722

| | | | | | |
|---|---|---|---|---|---|
| Across Flats Size (A/F) | 1.00 | 1.25 | 1.50 | 1.75 | 1.875 |
| d(Hole Size) (TB=RB) | .331 | .346 | .512 | .571 | .630 |
| Cross Section in² (1) | .780 | 1.259 | 1.744 | 2.396 | 2.733 |
| W (lbs/ft.) (2) | 2.640 | 4.260 | 5.902 | 8.108 | 9.248 |
| Moment of Inertia (I) (3) | .059 | .145 | .301 | .558 | .734 |
| Radius of Gyration (r) (4) | .275 | .339 | .415 | .483 | .518 |

(1) Cross section based on sharp cornered hexagon.

(2) W (lbs/ft) = Cross section × 3.384 $\frac{\text{lbs}}{\text{in}^2}$ ft (3) Moment of inertia I = .06 (Across Flats Size)⁴ − .049 d⁴

(4) Radius of gyration $r = \sqrt{\frac{I}{\text{cross section}}}$

Also, for the purposes of comparison, the following table shows the prior art ISO standard hollow round drill steel rod dimensions (ISO 1719 and 1720 (1974)):

TABLE IV

ISO STANDARD SIZES
HOLLOW ROUND DRILL STEEL
ISO 1719 & 1720

| | | | | |
|---|---|---|---|---|
| Nominal Dia. | 1.25 | 1.50 | 1.75 | 2.00 |
| Basic Size | 1.276 | 1.555 | 1.831 | 2.071 |
| Tolerance | +0 | +0 | +0 | +0 |
| | −.027 | −.039 | −.055 | −.063 |
| Basic Nominal Dia. (D) (1) | 1.263 | 1.536 | 1.804 | 2.040 |
| d (Hole Size) (TB=RB) | .346 | .512 | .571 | .630 |
| Cross Section in² (2) | 1.159 | 1.647 | 2.300 | 2.957 |
| W lbs/ft (3) | 3.921 | 5.574 | 7.783 | 10.006 |
| Moment of Inertia (I) (4) | .124 | .269 | .514 | .841 |
| Radius of Gyration (r) (5) | .327 | .404 | .480 | .533 |

(1) Basic nominal diameter $= \text{Basic Size} - \frac{\text{Tolerance}}{2}$ (2) Cross section $= .7854\,(D^2 - d^2)$ (3) W lbs/ft $= \text{Cross section} \times 3.384 \frac{\text{lbs}}{\text{in}^2}$ ft TABLE IV-continued

ISO STANDARD SIZES
HOLLOW ROUND DRILL STEEL
ISO 1719 & 1720

(4) Moment of inertia $= I = .049\,(D^4 - d^4)$ (5) Radius of gyration $= r = \sqrt{\frac{I}{\text{Cross section}}}$ By employing the formulae in Tables II, III, and IV for given thread diameters of 1.25, 1.5, 1.75, 2.0, 2.25 and 2.5 inches, the following maximum and minimum dimensions together with the corresponding properties of the extension rods of the present invention may be calculated and compared to the corresponding properties and dimensions of the ISO standard hexagonal and round hollow extension rods:

TABLE V

DIMENSIONS AND PROPERTIES COMPARISON TABLE

| TD | | RD | RX Min | RX Max | W Min | W Max | RB Min | RB Max | t Min | t Max |
|---|---|---|---|---|---|---|---|---|---|---|
| | (1) | 1" Hex | .780 nom | | 2.640 nom | | .331 nom | | — | |
| | (2) | 1-1/4" Rd | 1.159 " | | 3.921 " | | .346 " | | .452 | |
| 1.250 | (3) | 1.250 | .785 | | 2.656 | | .750 | | .250 | |
| | (4) | 1.250 | .785 | .933 | 2.656 | 3.157 | .612 | .750 | .250 | .319 |
| | | 1.375 | | | | | .838 | .944 | .216 | .269 |
| | (1) | 1-1/4"Hex | 1.259 nom | | 4.260 nom | | .346 nom | | — | |
| | (2) | 1-1/2"Rd | 1.647 " | | 5.574 " | | .512 " | | .494 | |
| 1.500 | (3) | 1.500 | 1.259 | | 4.260 | | .804 | | .348 | |
| | (4) | 1.500 | 1.131 | 1.343 | 3.827 | 4.545 | .735 | .900 | .300 | .383 |
| | | 1.650 | | | | | 1.006 | 1.132 | .259 | .322 |
| | (1) | 1-1/2"Hex | 1.744 nom | | 5.902 nom | | .512 nom | | — | |
| | (2) | 1-3/4"Rd | 2.230 " | | 7.783 " | | .571 " | | .590 | |
| 1.750 | (3) | 1.750 | 1.744 | | 5.902 | | .917 | | .417 | |
| | (4) | 1.750 | 1.539 | 1.828 | 5.208 | 6.186 | .857 | 1.050 | .350 | .447 |
| | | 1.925 | | | | | 1.174 | 1.321 | .302 | .376 |
| | (2) | 2"Rd | 2.957 nom | | 10.0006 nom | | .630 nom | | .685 | |
| 2.000 | (3) | 2.000 | 2.191 | | 7.414 | | 1.100 | | .450 | |
| | (4) | 2.000 | 2.011 | 2.388 | 6.805 | 8.081 | .980 | 1.200 | .400 | .510 |
| | | 2.200 | | | | | 1.341 | 1.510 | .345 | .430 |
| | (1) | 1-3/4"Hex | 2.396 nom | | 8.108 nom | | .571 nom | | — | |
| | (3) | 2.250 | 2.545 | | 8.612 | | 1.350 | | .450 | |
| 2.250 | (4) | 2.250 | 2.545 | 3.022 | 8.612 | 10.226 | 1.102 | 1.350 | .450 | .574 |
| | | 2.475 | | | | | 1.509 | 1.699 | .388 | .483 |
| | (1) | 1-7/8"Hex | 2.733 nom | | 9.428 nom | | .630 nom | | — | |
| | (3) | 2.500 | 3.142 | | 10.633 | | 1.500 | | .500 | |
| 2.500 | (4) | 2.500 | 3.142 | 3.731 | 10.633 | 12.626 | 1.225 | 1.500 | .500 | .638 |
| | | 2.750 | | | | | 1.677 | 1.887 | .432 | .537 |

| | | I Min | I Max | RF | IF Min | IF Max | r | SF |
|---|---|---|---|---|---|---|---|---|
| | (1) | .059 nom | | 1.000 | 1.000 | | .275 | 1.000 |
| | (2) | .124 " | | 1.485 | 2.102 | | .327 | 1.189 |
| 1.250 | (3) | .104 | | 1.006 | 1.764 | | .364 | 1.324 |
| | (4) | .104 | .113 | 1.006 | 1.764 | 1.912 | .364 | 1.324 |
| | | .136 | .151 | 1.196 | 2.308 | 2.559 | .402 | 1.462 |
| | (1) | .145 | | 1.000 | 1.000 | | .339 | 1.000 |
| | (2) | .269 | | 1.308 | 1.855 | | .404 | 1.192 |
| 1.500 | (3) | .228 | | 1.000 | 1.572 | | .426 | 1.257 |
| | (4) | .216 | .239 | .898 | 1.489 | 1.647 | .437 | 1.289 |
| | | .283 | .313 | 1.067 | 1.950 | 2.159 | .483 | 1.425 |
| | (1) | .301 | | 1.000 | 1.000 | | .415 | 1.000 |
| | (2) | .514 | | 1.319 | 1.708 | | .480 | 1.157 |
| 1.750 | (3) | .425 | | 1.000 | 1.412 | | .494 | 1.190 |
| | (4) | .400 | .433 | .882 | 1.329 | 1.439 | .510 | 1.229 |
| | | .524 | .580 | 1.048 | 1.740 | 1.926 | .563 | 1.357 |
| | (2) | .841 | | 1.000 | 1.00 | | .533 | 1.000 |
| 2.000 | (3) | .712 | | .741 | .847 | | .570 | 1.069 |
| | (4) | .682 | .739 | .680 | .811 | .878 | .583 | 1.094 |
| | | .893 | .984 | .808 | 1.062 | 1.171 | .642 | 1.205 |
| | (1) | .558 | | 1.000 | 1.00 | | .483 | 1.000 |
| | (3) | 1.093 | | 1.062 | 1.959 | | .655 | 1.356 |
| 2.250 | (4) | 1.093 | 1.184 | 1.062 | 1.959 | 2.121 | .655 | 1.356 |
| | | 1.430 | 1.585 | 1.261 | 2.563 | 2.840 | .724 | 1.499 |
| | (1) | .734 | | 1.000 | 1.00 | | .518 | 1.000 |
| | (3) | 1.666 | | 1.150 | 2.270 | | .728 | 1.405 |
| 2.500 | (4) | 1.666 | 1.804 | 1.128 | 2.270 | 2.457 | .728 | 1.405 |
| | | 2.181 | 2.415 | 1.339 | 2.972 | 3.290 | .805 | 1.554 |

(1) ISO Hollow Hexagon - Table III
(2) ISO Hollow Round - Table IV
(3) Preferred properties and dimensions of present invention
(4) Broad range properties and dimensions of present invention From Table V, it is apparent that the present invention improves over prior art ISO standard hexagonal and round extension rods in both the strength to weight ratio (SF) and the radius of gyration (*r*). Furthermore, the extension rods of the present invention improve over the commonly used ISO standard hexagonal extension rods by improved moments of inertia as shown by the greater values of IF for the present invention. In particular, the relative dimensions of the extension rods of the present invention greatly improve over the ISO standard hollow extension rods by not only decreasing the required cross section but also increasing the strength to weight ratio, as shown in the following table.

TABLE VI

PROPERTIES OF THE PRESENT INVENTION COMPARED WITH HOLLOW ROUND EXTENSION ROD ISO 1719 AND 1720

| TD | RF | SF |
|---|---|---|
| 1.25 | .805 | 1.229 |
| 1.50 | .815 | 1.196 |
| 1.75 | .820 | 1.173 |
| 2.0 | .808 | 1.205 |

The following table shows a sample calculation of a percussive drill extension rod in accordance with the present invention:

TABLE VII

Sample Calculation

| | | |
|---|---|---|
| TD selected | | 1.5 in |
| TDX $\pi\left(\frac{1.5}{2}\right)^2$ | = | 1.767 in$^2$ |
| RD selected | | 1.5 in |
| RDX $\pi\left(\frac{1.5}{2}\right)^2$ | = | 1.767 in$^2$ |
| RX min .64 TDX | = | 1.131 in$^2$ |
| RX max .76 TDX | = | 1.343 in$^2$ |
| RX selected same as ISO Std 1.25" hex | = | 1.259 in$^2$ |
| RB $2\left(\sqrt{\frac{1.767 - 1.259}{\pi}}\right)$ | = | .804 in |
| t $\frac{1.5 - .804}{2}$ | = | .348 in |
| I $.049\,(1.5^4 - .804^4)$ | = | .228 |
| IF $\frac{.228}{.145}$ | = | 1.572 |
| RF $\frac{1.259}{1.259}$ | = | 1.0 |
| r $\sqrt{\frac{.228}{1.259}}$ | = | .426 |
| SF $\frac{.426}{.339}$ | = | 1.257 |

In view of the foregoing, it is readily seen that the present invention achieves manufacturing, cost, and operating advantages in increasing the moment of inertia relative to the cross section of the extension rod while also achieving improved strength to weight ratios. For example, by maintaining the cross-sectional areas of the rod zone in the preferred extension rods of the present invention the same as the ISO hexagonal extension rods but increasing the outer rod diameter in accordance with the present invention, the stiffness of the extension rods may be improved as shown by the increases in the moments of inertial listed in the Table V above.

Another advantage to be gained by enlargement of the outside diameter of the extension rod lies in an improved ability to lift cuttings from the bottom of the drilled hole. To remove cuttings effectively, the clearing between the drilled hole diameter and the outside diameter of the extension rods must be minimized in order to obtain the optimum air stream velocity consistent with providing adequate running clearance between the drilled hole and the extension rods. Effective removal of cuttings from a drilled hole generally requires an annular air velocity of 4000 feet per minute, annular air velocity being governed by the air consumption of the tool, its size, and extension rod diameter. The improvements in air velocity achieved by the present invention may be shown by calculating the air velocity according to the following formula:

$$\text{Air Velocity (FPM)} = \frac{\text{Air Supply (CFM} \times 144}{\text{Cross section of hole} - \text{Cross Section of Rod Outside Diameter}}$$

The extension rods of the present invention may be manufactured in the following manner. Tubing is selected for the appropriate inside (RB) and outside (RD) rod zone diameters and cut to the appropriate length. The ends of the cut tube are then heated so that the internal and external transitions zones will be properly formed. Next, the ends of the tube are upset forged, which slightly increases the outside diameter and decreases the inside diameter of the tube ends to form the desired value of TB. The outer surfaces of the ends are then machined, and threaded so that the selected value of TD is achieved. When the selected value of RD is larger than the selected value of TD, the outside diameter (RD) of the tube would be swaged down locally at each end to approximate TD; then the tube would be heated and upset forged as before.

Instead of providing the extension rod with two threaded ends of equal diameter, one threaded end may have a diameter greater than the other end, such an extension rod being known as a jumbo rod. Jumbo rods are not coupled together and are commonly used for holes up to 16 feet in depth. The smaller thread diameter at one end permits use of a smaller than standard drill bit, while retaining the advantage of a larger thread, coupling, and striker bar at the machine end. These rods are used largely on multi-boom equipment for production drilling in mineral extraction and tunneling. A jumbo rod in accordance with the present invention would have all of the pertinent dimensions based upon the smaller thread diameter so that such a rod would be essentially identical to a rod with equal thread diameters at each end in accordance with the present invention, except that one end would have a larger thread diameter. Basing the pertinent dimensions on the smaller thread diameter is accomplished in the smaller manner as the sample calculation in Table VII above. In manufacturing a jumbo rod in accordance with the present invention, the same method outlined above is used except that one end is upset forged to a greater degree to provide the larger thread diameter at one end; as a result thereof the thread bore diameter (TB) at that end will correspond in relative size to the larger thread diameter. One example of a series of jumbo rods in accordance with the present invention would be as follows:

| Smaller TD | Larger TD |
|---|---|
| 1.25 | 1.50 |
| 1.50 | 1.75 |
| 1.75 | 2.00 |
| 2.00 | 2.25 |
| 2.25 | 2.50 |
| 2.50 | 2.75 |

with the balance of the pertinent dimensions being listed in Table V under the appropriate entries based upon the smaller TD. It will be recognized that the larger TD in the above list is one full size greater than the smaller TD but that it could be more or less without departing from the scope of the present invention.

What is claimed is:

1. A substantially round, percussive drill extension rod adapted to withstand high velocity strain pulses superimposed on rotary forces in percussive drilling comprising an elongated body having first and second externally threaded ends, a rod zone therebetween, and a substantially round, internal bore in the threaded ends and in the rod zone along the longitudinal axis of the body, said internal bore having a constant diameter throughout said rod zone and providing fluid communication through the extension rod along the longitudinal axis, said first threaded end having an outside diameter in the range of about 1.25 to about 2.5 inches, said rod zone having an outside diameter within a range from about equal to the outside diameter of said first threaded end to about 1.1 times the outside diameter of said first threaded end, said rod zone having an annular cross-sectional area equal to from about 0.64 to about 0.76 times the circular cross-sectional area of the outside diameter of said first threaded end, and said rod zone having an internal bore diameter equal to 2(√(circular cross section based on the outside diameter of of the rod zone minus the annular cross section of the rod zone) divided by $\pi$).

2. A percussive drill extension rod as claimed in claim 1 wherein a transitional zone connects the rod zone to each threaded end, the transition zone comprising an external transition zone and an internal transition zone, said external transition zone having a length greater than or equal to the outside diameter of the rod zone, and said internal transition zone having a length greater than or equal to the inside diameter of the rod zone.

3. A percussive drill extension rod as claimed in claim 1 wherein the rod zone has at least one wrench flat.

4. A percussive drill extension rod as claimed in claim 1 wherein said first and second threaded ends have equal outside diameters.

5. A percussive drill extension rod as claimed in claim 1 wherein said second threaded end has an outside diameter greater than the outside diameter of said first threaded end.

6. A substantially round, percussive drill extension rod adapted to withstand high velocity strain pulses superimposed on rotary forces in percussive drilling comprising an elongated body having two externally threaded ends, a rod zone therebetween, and a substantially round, internal bore in the threaded ends and in the rod zone along the longitudinal axis of the body, said internal bore having a constant diameter throughout said rod zone and providing fluid communication through the extension rod along the longitudinal axis, said threaded ends having an outside diameter in the range of about 1.25 to about 2.5 inches, said rod zone having an outside diameter within a range from about equal to the outside diameter of said threaded ends to about 1.1 times the outside diameter of said threaded ends, said rod zone having an annular cross-sectional area equal from about 0.64 to about 0.76 times the circular cross-sectional area based on the outside diameter of the threaded ends, and said rod zone having an internal bore diameter equal to 2(√(circular cross section based on the outside diameter of the rod zone minus the annular cross section of the rod zone) divided by $\pi$).

7. A percussive drill extension rod adapted to withstand high velocity strain pulses superimposed on rotary forces in percussive drilling comprising an elongated body having two externally threaded ends, a rod zone therebetween, and a substantially round, internal bore in the threaded ends and in the rod zone along the longitudinal axis of the body, said internal bore having a constant diameter throughout said rod zone and providing fluid communication through the extension rod along the longitudinal axis, the outside diameter of the threaded ends (TD) having an approximate value selected from the group consisting of 1.25, 1.5, 1.75, 2.0, 2.25, and 2.5 inches, and said rod zone having an outside diameter (RD) and an inside diameter (RB) within the following ranges for the selected values of TD:

| TD | RD min | RD max | RB min | RB max |
|---|---|---|---|---|
| 1.25 | 1.25 | 1.375 | 0.612 | 0.944 |
| 1.50 | 1.5 | 1.65 | 0.735 | 1.132 |
| 1.75 | 1.75 | 1.925 | 0.857 | 1.321 |
| 2.0 | 2.0 | 2.2 | 0.98 | 1.51 |
| 2.25 | 2.25 | 2.475 | 1.102 | 1.699 |
| 2.5 | 2.5 | 2.75 | 1.225 | 1.887 |

so that the annular cross section of the rod (RX) will be within the range of about 0.64 to about 0.76 ($\pi$ (TD)$^2$/4).

* * * * *

UNITED STATES PATENT AND TRADEMARK OFFICE

CERTIFICATE OF CORRECTION

PATENT NO. : 4,051,906

DATED : October 4, 1977

INVENTOR(S) : Edward Alfred Donegan

It is certified that error appears in the above-identified patent and that said Letters Patent are hereby corrected as shown below:

Column 9, line 25 delete "of" (second occurrence)

Signed and Sealed this

*Seventh* Day of *March 1978*

[SEAL]

*Attest:*

RUTH C. MASON
*Attesting Officer*

LUTRELLE F. PARKER
*Acting Commissioner of Patents and Trademarks*